US006352455B1

(12) United States Patent
Guagliano et al.

(10) Patent No.: US 6,352,455 B1
(45) Date of Patent: Mar. 5, 2002

(54) MARINE PROPULSION DEVICE

(76) Inventors: Peter A. Guagliano, 2285 Marsh Hen Dr.; Anthony C. Ross, 3546 Maybank Hwy., both of John's Island, SC (US) 29455

( * ) Notice: Subject to any disclaimer, the term of this patent is extended or adjusted under 35 U.S.C. 154(b) by 0 days.

(21) Appl. No.: 09/599,239

(22) Filed: Jun. 22, 2000

(51) Int. Cl.[7] ..... B63H 11/00; F01B 19/04

(52) U.S. Cl. ..... 440/38; 60/201; 60/222; 417/412; 417/478; 92/93

(58) Field of Search ..... 440/13, 17, 18, 440/23, 38; 60/201, 221, 222; 417/412, 472, 475, 478, 521, 545, 552; 92/50, 53, 60, 93

(56) References Cited

U.S. PATENT DOCUMENTS

| | | | | |
|---|---|---|---|---|
| 2,056,475 A | | 10/1936 | Marx | |
| 2,815,715 A | | 12/1957 | Tremblay | |
| 2,971,471 A | | 2/1961 | Huebschman | |
| 3,062,002 A | | 11/1962 | Shaffer | |
| 3,074,351 A | | 1/1963 | Foster | |
| 3,136,257 A | | 6/1964 | Smith et al. | |
| 3,190,229 A | | 6/1965 | Turowski | |
| 3,215,084 A | | 11/1965 | Cline | |
| 3,359,735 A | * | 12/1967 | Yeager, Sr. | 60/221 |
| 3,677,667 A | | 7/1972 | Morrison | |
| 3,765,175 A | | 10/1973 | Ohnaka | |
| 3,826,217 A | | 7/1974 | Canova | |
| 3,836,289 A | | 9/1974 | Wolford et al. | |
| 3,839,983 A | | 10/1974 | McAusland | |
| 3,945,201 A | | 3/1976 | Entringer | |
| 4,026,235 A | | 5/1977 | Woodfill | |
| 4,031,844 A | | 6/1977 | Onal et al. | |
| 4,076,467 A | | 2/1978 | Persson | |
| 4,389,169 A | | 6/1983 | De Dionigi | |
| 4,488,854 A | * | 12/1984 | Miller | 417/241 |
| 4,787,823 A | | 11/1988 | Hultman | |
| 4,925,377 A | | 5/1990 | Inacio et al. | |
| 5,085,563 A | | 2/1992 | Collins et al. | |
| 5,108,426 A | * | 4/1992 | Biro et al. | 623/3.17 |
| 5,298,818 A | | 3/1994 | Tada | |
| 5,333,444 A | | 8/1994 | Meng | |
| 5,567,131 A | | 10/1996 | McNaull | |
| 5,620,048 A | | 4/1997 | Beauquin | |
| 5,717,259 A | | 2/1998 | Schexnayder | |
| 5,915,930 A | | 6/1999 | McNaull | |
| 6,012,910 A | | 1/2000 | McNaull | |

FOREIGN PATENT DOCUMENTS

| | | |
|---|---|---|
| DE | 3004109 | 8/1981 |
| JP | 0115906 | 10/1978 |

* cited by examiner

*Primary Examiner*—S. Joseph Morano
*Assistant Examiner*—Andrew Wright
(74) *Attorney, Agent, or Firm*—Browning Bushman

(57) ABSTRACT

The propulsion device (10) includes a housing (12) having an incoming end cap (14) and an outflowing end cap (16). A tubular bladder (20) within the housing is interconnected to each end cap, thereby varying the volume of both a chamber (22) within the bladder and a chamber (24) between the bladder and the housing during attractive or repulsive movement between end caps (14,16). Check valves control the flowthrough the end caps. The propulsion device is highly efficient and is able to move the vessel through water with little or no cavitation.

25 Claims, 4 Drawing Sheets

MARINE PROPULSION DEVICE

FIELD OF THE INVENTION

The present invention relates to device for propelling a vessel, such as a submarine, through water. More particularly, this invention relates to a highly efficient propulsion device which desirably results in little, if any, cavitation.

BACKGROUND OF THE INVENTION

Those skilled in the art of propelling ships and submarines through water have long recognized the desirability of a highly efficient non-cavitating propulsion device. The more complicated the propulsion system the greater the possibility of mechanical failure. Water's viscosity restricts movement of a vessel through the water. As a propeller pushes or pulls a vessel, bubbles begin to form on the low pressure surface of the propeller from cavitation and this cavitation alters the physics in the propeller's function. Submarines conventionally must be operated at a very low speed to achieve little, if any, cavitation. The cavitation action itself also contributes to inefficiency of the propulsion device.

Numerous patents disclose pumps, including oscillating pumps and electromagnetically driven pumps. Many of these pumps are designed for a specific application. U.S. Pat. Nos. 2,815,715, 2,971,471, 3,074,351, 3,136,257, 3,215,084, 3,190,229, 3,836,289, 3,677,667, 3,839,983, 4,389,169, 4,787,823, 4,925,377, 5,085,563, 5,620,048, 5,567,131, and 5,115,930 disclose various types of pumps. Japanese reference 115906 and DE 3004109 are illustrative of non-U.S. pump patents. U.S. Pat. No. 4,076,467 discloses a pump having a tubular resilient pump element and one-way valve. The device has limited efficiency. Column 3 commencing at line 1 discloses an elastic tube which utilizes opposing helix reinforced filaments.

Prior art patents relating to propulsion systems for moving a vessel through water are disclosed in U.S. Pat. Nos. 2,056,475, 3,062,002 and 3,765,175. Devices specifically designed for powering boats include U.S. Pat. Nos. 3,826,217, 3,945,201, 4,026,235 and 4,031,844.

U.S. Pat. No. 5,298,818 discloses a thrust generator which utilizes superconducting magnets to push the fluid and thus propel the vessel through water. U.S. Pat. No. 5,333,444 discloses a superconducting electromagnetic thruster, and U.S. Pat. No. 5,717,259 discloses an electromagnetic machine which includes a rigid elongated hollow shell wrapped with wire which is connected to a power source. When current is flowing through the wire, the particles are attracted radially outward to deform the pouch.

The disadvantages of the prior art are overcome by the present invention, and an improved device is hereinafter disclosed suitable for propelling a vessel through water. The device is relatively simple in operation yet is both highly efficient and desirably results in little, if any, cavitation.

SUMMARY OF THE INVENTION

The present invention is directed to an propulsion device suitable for propelling a vessel, such as a submarine, through water. The device desirably results in little, if any, cavitation while propelling the device through water at a relatively high speed. Cavitation commonly occurs in a pump when the suction fluid is under a low pressure/high vacuum condition where the liquid turns into a vapor at the inlet of the device. This vapor is carried over to the discharge side of the device where it no longer "sees" vacuum and is compressed back into a liquid by the discharge pressure. This imploding action occurs violently and attacks the rotors, screws, gears, etc. that have been operating under a suction cavitation condition. Large chunks of material may be slowly removed from the exposed faces, thereby causing premature failure of the propulsion device. Cavitation occurs in a propeller or screw system when the water is "pulled apart" resulting in a noisy trailing foam that is easily detected both visually and auditory. The propeller cannot operate as efficiently in a foam environment as an uncavitated environment.

The propulsion device according to the present invention may utilize magnetic propulsion and contraction forces to change the length and thus the internal volume within a flexible bladder, which preferably is reinforced with a weave comprising fibrous reinforcing members. In an alternate embodiment, hydraulic power to cylinders is controlled to effect movement of the end caps and thereby cyclically change the volume of the inner chamber and the outer chamber which are separated by the bladder. Volume changes within the bladder and the volume changes between the bladder and the external housing are used to generate the propulsion forces. A clamshell device may be used to obtain reverse thrust.

To create compressive forces to move fluid, the device utilizes both an inner chamber and an outer chamber which each contribute to the filling and draining phase of the other. The device according to the present invention thus fills an outer chamber with water as the inner chamber is venting, then the device fills the inner chamber with water while the outer chamber is venting. This feature minimizes the pressure differential, which decreases the work and thus the effort needed for the propulsion device to function at a particular speed. Since the device does not require a suction action for filling the chamber, the contained water will not be subjected to gross negative forces that cause the gases to come out of solution. Water is then pressurized in the chambers and released to ambient pressure producing negligible cavitation. Since the device does not use a high differential between the filling pressure and the ambient pressure, the power generated is in propulsion.

It is a feature of the invention that the propulsion device may utilize valves which include polymer reeds that are in a tricuspid and/or bicuspid configuration similar to that of a human heart valve. Each valve in the device may be sized analogous to cardiac portions in the heart valve. The valves preferably are self-cleaning and quiet, and also have high efficiency and longevity.

It is a further feature of the invention that the material which provides the helix reinforcement may be formed of a carbon fiber, an aromatic polyamide fiber such as Kevlar, or currently advanced reinforcement which has significantly better fatigue properties than metal wire.

Another feature of the invention is that the propulsion device utilizes moving parts that are forgiving. In the event of failure of a valve, for example, the device may still propel through water.

The propulsion device according to the present invention is highly versatile; the length of stroke for the device may be full or partial.

A further feature of the invention is that the propulsion device utilizes attracting and repelling end caps and conventional sealing members, such as o-rings with reduced friction, to form reliable seals within the device. The device preferably utilizes ambient pressure and direction of motion to facilitate filling of the chambers.

Yet another feature of the invention is that the device may be electrically powered to change the magnetic attraction and repulsion of the end caps, or may be hydraulically powered to serve this same purpose.

An advantage of the invention is that the device is relatively simple and thus highly reliable. The further advantage of the invention is that the magnetic propulsion device will provide a relatively long life with few service problems.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
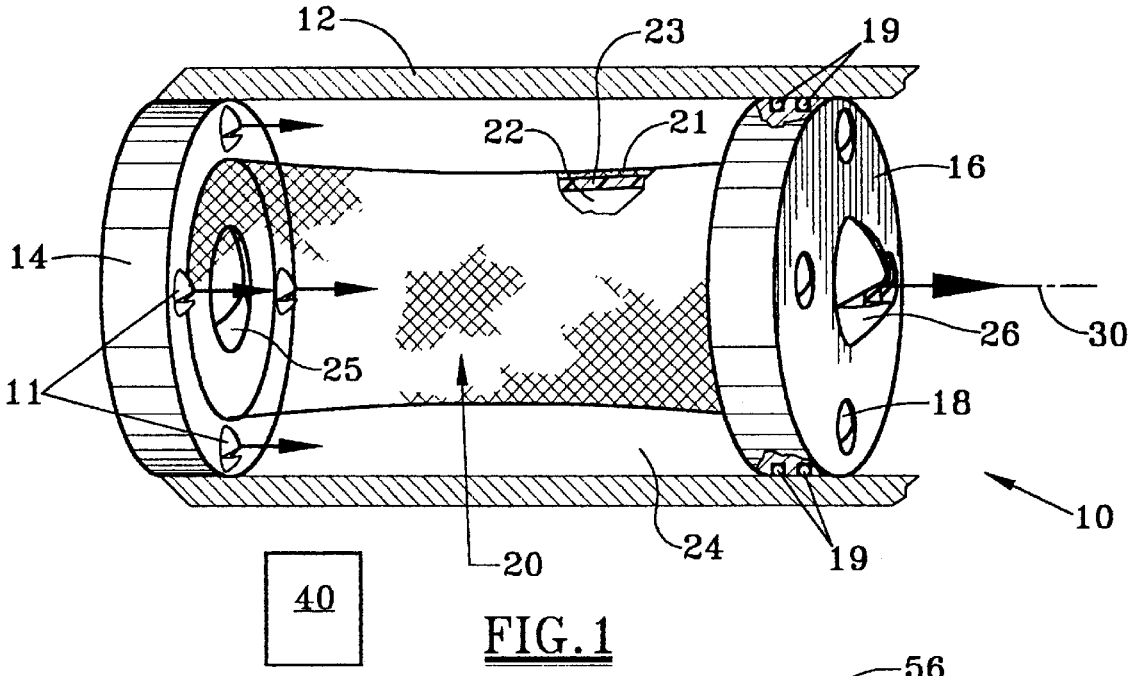
FIG. 1 is a pictorial view of one embodiment of a propulsion device according to the present invention, with the housing in cross-section.

FIG. 1 depicts one embodiment of a magnetic propulsion device 10 according to the present invention. The device 10 comprises a sleeve-shaped housing 12 extending from an incoming or leading end cap 14 to an outflowing or trailing end cap 16. Housing 12 is conventionally sealed to each of the end caps 14, 16 and is fixed to the structure of the associated vessel. Each of the end caps may be provided with a plurality of one-way acting valves or check valves, such as valve 18. In FIG. 1, four circumferentially spaced check valves 11 are provided in the end cap 14, and four similar circumferentially spaced check valves 18 are provided in the end cap 16. A sleeve-shaped flexible bladder 20, which preferably includes a fibrous reinforced weave 21 as an outer layer, is sealed at each end to the end caps 14, 16, thereby forming an inner chamber 22 within the bladder 20, and an annular outer chamber 24 between the bladder 20 and the cylindrical housing 12. One or more seals 19 carried by the end cap 16 provide continuous sealing engagement with the casing 12.

Bladder 20 may be formed of separate layers such as an inner layer 23 of an elastomeric material and a separate outer layer 21 of a woven high strength fibrous material. The high strength fibrous material may be positioned in a separate outer layer or may be combined with an elastomeric material in a composite layer as may be desired. Further, it may be desirable to form bladder 20 of a composite or combined material such as a combined elastomeric material and a fibrous material. In some instances, metal windings may be desirable in the composite material. The greater the arc of rotation of the helix windings, the better the efficiency of the propulsion device.

An aromatic polyamide fiber, such as Kevlar, provides a high strength fiber for a composite material. Single check valve 25 may be centrally located with the leading end cap 14, and a similar check valve 26 is provided in the outflowing end cap 16. In the propulsion device 10 the leading end cap 14 is fixed to housing 12 which is fixed to the structure of the vessel and the trailing end cap 16 is movable relative to housing 12 and may be a moveable piston for providing the propulsion. Under certain conditions, it may be desirable to have trailing end cap 16 fixed or to have both end caps 14 and 16 movable. Each of the valves 11, 18, 25, 26 are discussed in further detail below.

Each of the leading end cap 14 and the outflowing end cap 16 are electromagnetically powered or in some applications may be powered by a permanent magnet or a combination of permanent and electromagnets. Either or both of the end caps 14, 16 may thus be moveable along the central axis 30 of the propulsion device. Device 10 utilizes the physics of magnetic repulsion and attraction to create forces which cause a tensioning of the bladder 20. The repulsion of the end faces 14, 16 axially separate the end plates, thereby tensioning the bladder 20 and increasing the length and decreasing the diameter of the bladder, thereby resulting in a decrease in the interior volume of the chamber 22 within the bladder. During this tensioning of the bladder, water within the chamber 22 will be displaced through the valve 26 in such a manner that transport of the outflowing end cap 16 and movement of the vessel will occur. The polarity will then be reversed, causing an attractive force between the end caps 14, 16 which will result in a decrease in the axial length of the bladder 20 and an increase in the interior chamber 26, resulting in a filling of the bladder through the one-way inlet valve 25. At the same time, the outer chamber 24 will decrease in volume, causing an expulsion of displaced water through the check valves 18. This action will create a substantially continuous flow of water through the end cap 16, and the substantially continuous flow of incoming water through the end cap 14. The conventional power supply 40 may be used to regulate the power continuously to each of the end caps and thereby the magnetic attraction and repulsion of the end caps.

Pressurization of the bladder 20 will thus cause movement of the water in the outer chamber 24 through the valves 18 while fluid is incoming to the chamber 22 through valve 25. Conversely, water will be expelled through the check valve 26 while water is incoming to the outer chamber through the check valves 11. Filling of the outer chamber 24 assists in the reduction of the volume of the bladder 20, thereby optimizing the energy utilized and creating an operation which is more efficient than a simple "squeeze-and-squirt" action.

Figure 6A:
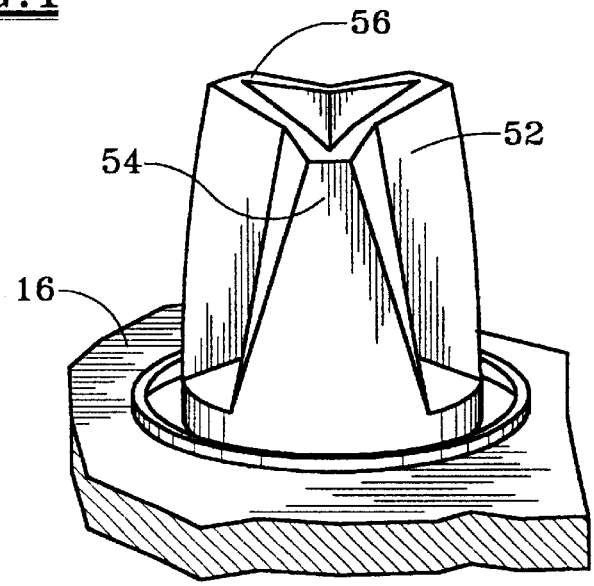
FIG. 6A is a simplified pictorial view of one of the valves which may be used in the magnetic propulsion device according to the present invention showing the valve in an open position.
Figure 6B:
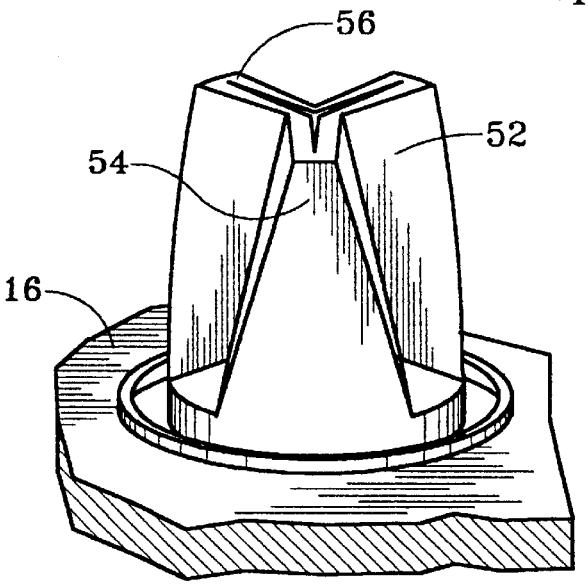
FIG. 6B is a pictorial view similar to FIG. 6A but showing the valve in a closed position.

As shown in FIG. 6, each of the valves may be designed to mimic the anatomy of the tricuspid valve of a human heart. Polymer reeds or pointed flaps 52, 54 and 56 are depicted. The preferred model may include reinforcement members similar to the chordae tendonae of a human heart valve to facilitate closing of the valves. The valves may be cushioned or silenced and may be closed completely or incompletely. A bicuspid valve may also be utilized under certain conditions.

Figure 2:
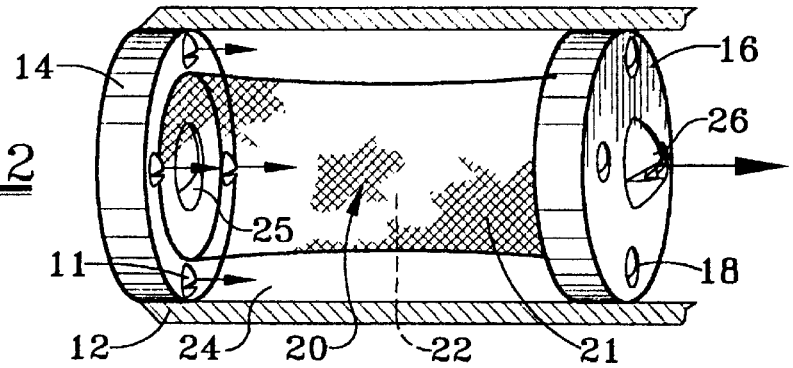
FIGS. 2, 3, 4 and 5 are pictorial views of the propulsion device as shown in FIG. 1, illustrating sequentially the movement of components and the direction of water flowing through the device.
Figure 3:
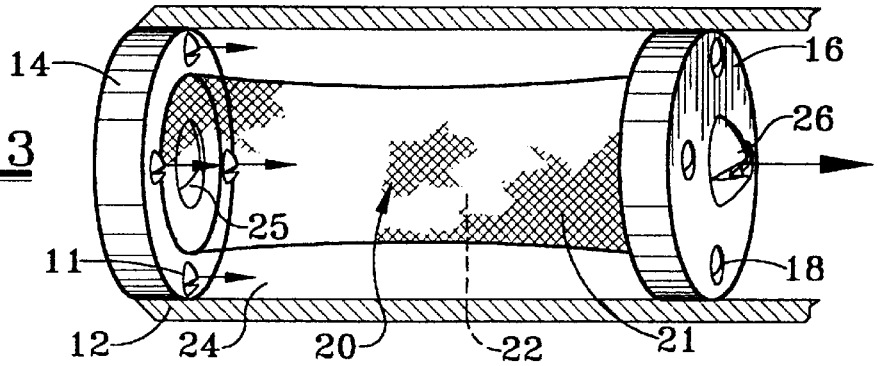
Figure 4:
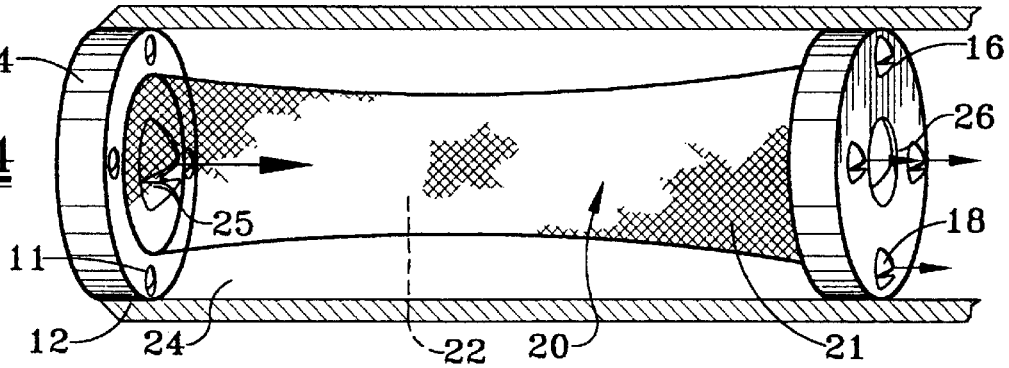
Figure 5:
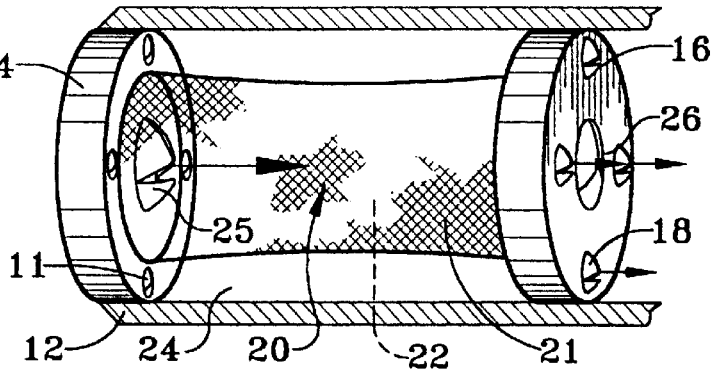

FIGS. 2–5 sequentially show the operation of the propulsion device 10 and the sequential tensioning and relaxing of the bladder 20 resulting in the variations in both the internal chamber 22 and the external chamber 24 which will dispel water from the chambers and thus propel the device. It should be understood that the change in spacing between the end caps is exaggerated in FIGS. 2–5, and that the fibrous weave and the helix windings as discussed above may contribute to the reduction in the internal volume of the bladder with increased separation of the end plates. Comparing FIGS. 2 and 3, the end caps 14, 16 have axially separated, thereby reducing the volume of the internal chamber 22 and increasing the volume of the external chamber 24. Comparing FIGS. 3 and 4, the end caps 14, 16 have moved further apart, thereby further reducing the volume of the internal chamber 22 and increasing the volume of the external chamber 24. Comparing FIGS. 4 and 5, the internal volume of the internal chamber 22 has increased to the point that the bladder 20 approximates a generally cylindrical shape as shown in FIG. 2 while minimizing the volume of outer chamber 24.

The propulsion device 10 is preferably designed to prevent movement of bladder 20 past a cylindrical shape and to a barrel-shaped geometry. This may be accomplished by having a tight Kevlar winding which would restrict expansion of bladder 20 past a cylindrical shape. Alternatively, the axial spacing between the end caps may be controlled to ensure that the bladder cannot form a barrel-shaped geometry. While inner liner 23 is shown as an elastomeric impermeable material, liner 23 could be formed to permit a small amount of water leakage between the inner chamber and the outer chamber and yet retain its elastomeric quality. The weave material 21 preferably is positioned within or outward of the bladder 20. Alternative, the bladder itself may be formed from a weave material, so that the bladder reliably serves a fluid separation purpose while perhaps permitting a small flow through the bladder and between the chamber under some circumstances.

The device of the present invention thus may be positionally independent, i.e. its efficiency need not depend on its orientation. This is significant compared to, for example, ball-type check valves which are influenced by gravity to seat the ball. The length of the stroke at one end cap relative to the other end cap may be altered by adjusting the cycle time and the power supply to the electromagnetic end caps 14, 16. In some applications, the electromagnets may create a magnetic field which may be concealed, thereby concealing the propulsion device and reducing the possibility of unfavorable detection. In a preferred embodiment, either or both permanent magnets and electromagnets may be centrally located and placed so as not to impair the reinforcement function of the weave, and instead to facilitate the orientation of the weave 21.

Figure 7A:
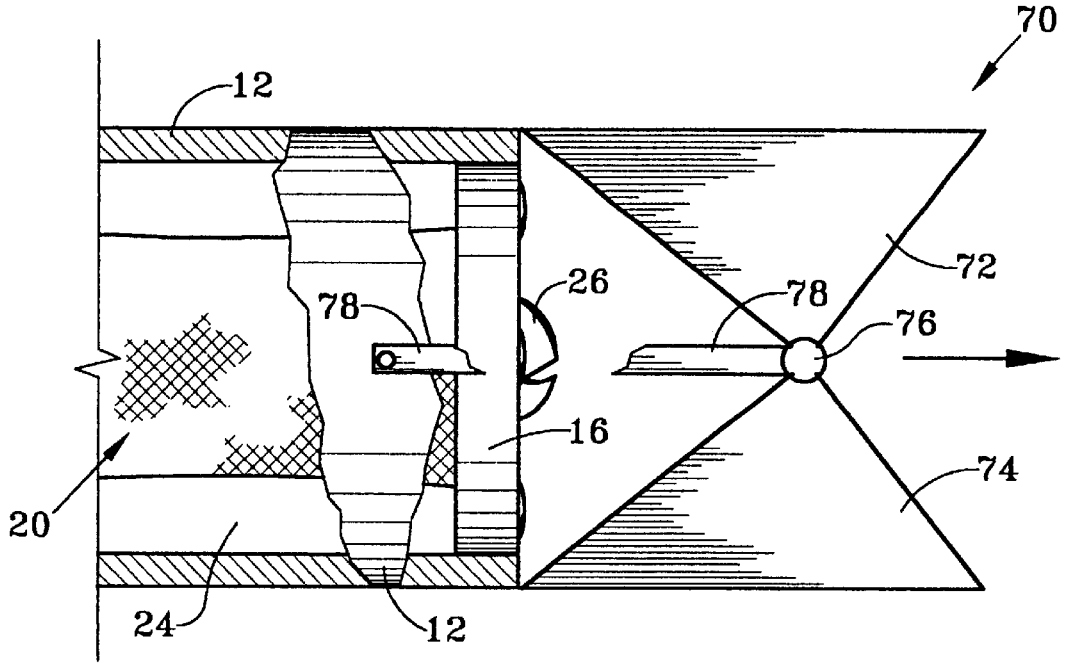
FIG. 7A is a simplistic side view of a portion of the propulsion device as shown in FIG. 1 and a clamshell deflector in an open position which may be used to obtain a reverse thrust.
Figure 7B:
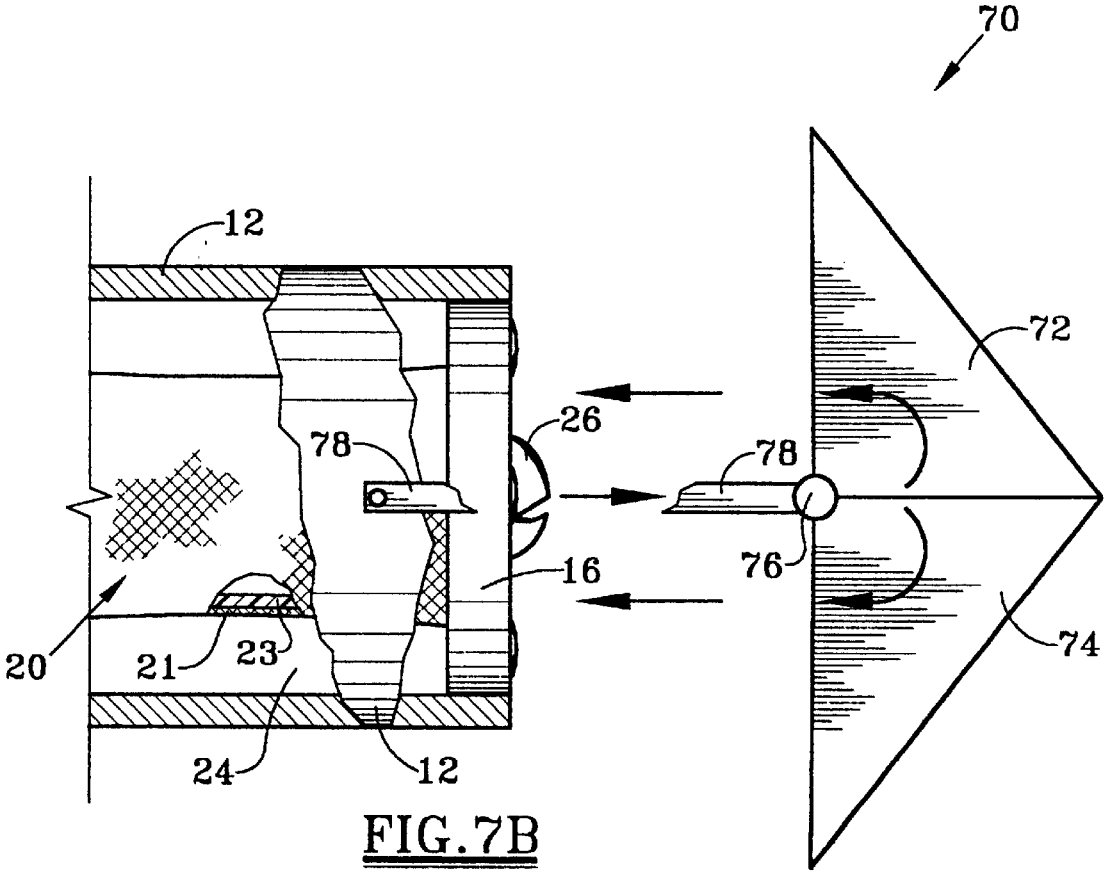
FIG. 7B is a side view similar to FIG. 7A but showing the clamshell deflector in a closed deflecting position for a reverse thrust.

As a further feature of the invention, the output of the device may be directed for reverse thrust by using a clamshell deflector 70, as shown in FIGS. 7A and 7B. Clamshell deflector 70 is shown schematically in FIGS. 7A and 7B with clamshell halves 72, 74 mounted for pivotal movement about axis 76 on opposed arms 78 between an open position as shown in FIG. 7A and a closed position as shown in FIG. 7B. When in a closed position, the water is deflected by clamshell halves 72, 74 to reverse the thrust of propulsion device 10. Thus, deflector 70 is effectively constructed to cause a parachute-like effect for the over the hull current of the associated vessel and a deflector for the produced propulsion. If both end caps 14, 16 are moveable along central axis 30, the end caps 14, 16 may be positioned within housing 12 at a predetermined distance from deflector 70. Under some conditions it may be desirable to utilize adjustable stops for end caps 14, 16. As an alternative, an auxiliary propulsion device may be provided specifically for obtaining the desired reverse thrust. In a preferred embodiment, the outer surface of the deflector would be contiguous with the outer wall of the housing, as shown in FIG. 7A, to minimize turbulence during forward motion of the vessel.

Another deflector may be attached to facilitate steering of the vessel, i.e., movement along the X, Y and Z axes. The deflector may, if desired, spin or otherwise rotate with respect to the housing. In yet another embodiment, the propulsion devices may be mounted on articulating arms for steering the vessel.

The magnetic propulsion device 10 may be constructed utilizing the dimensions appropriate to desired usage. In a preferred embodiment, the device 10 is used as the propulsion device for powering a submersible vessel, such as a submarine or an underwater pod. Since the water is higher or above ambient pressure as it passes through the device, no cavitation occurs. Water flowing through the inlet check valves may briefly be at or only slightly below ambient pressure, so that cavitation is negligible or nonexistent. The device thus produces little if any cavitation of water, thereby reducing the likelihood of the submarine being detected. It should be understood that even if one of the valves within the device were to fail, the propulsion device would continue to function, although at reduced efficiency.

Figure 8:
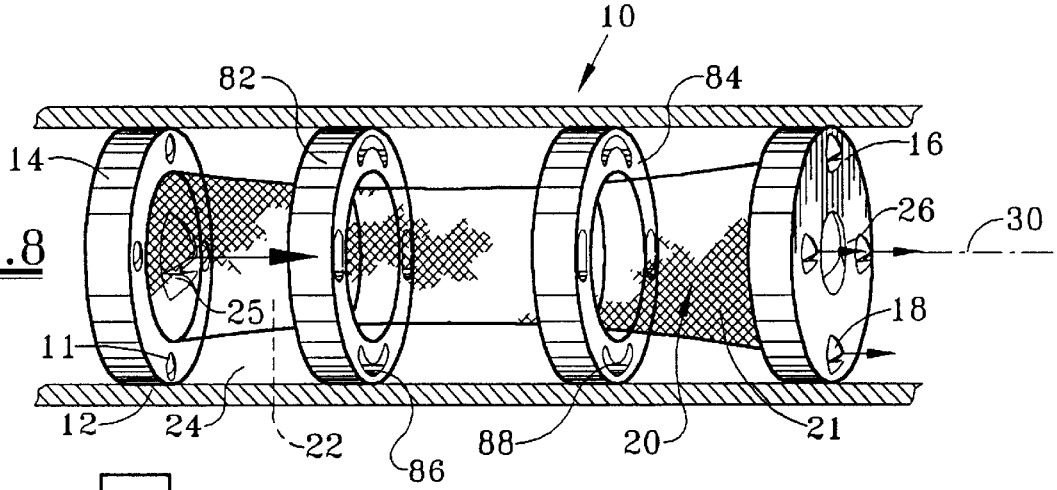
FIG. 8 is a pictorial view of another embodiment of a propulsion device according to the present invention.
Figure 9:
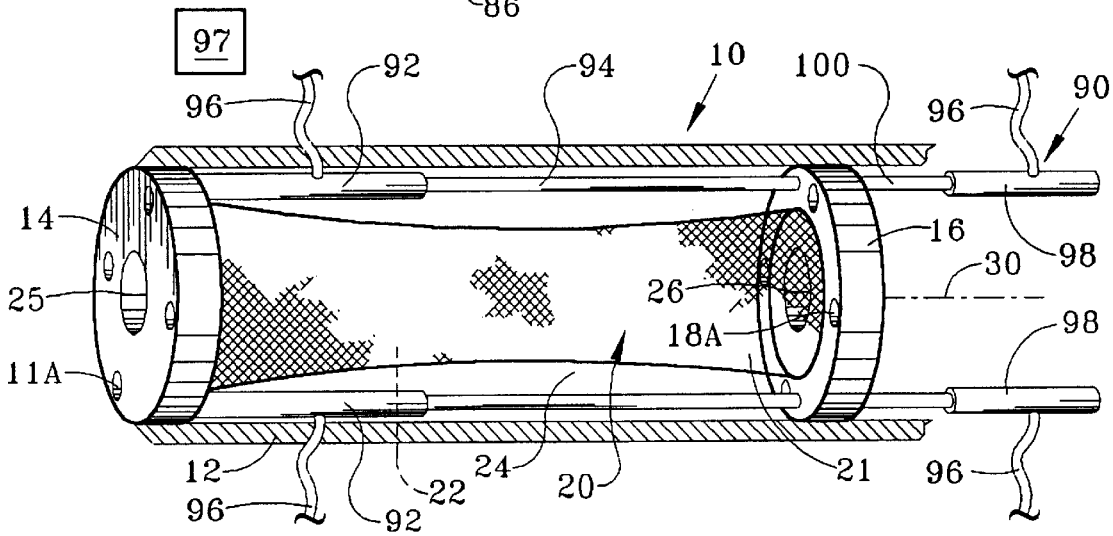
FIG. 9 is a pictorial view of yet another embodiment of a propulsion device according to the present invention.
Figure 10:
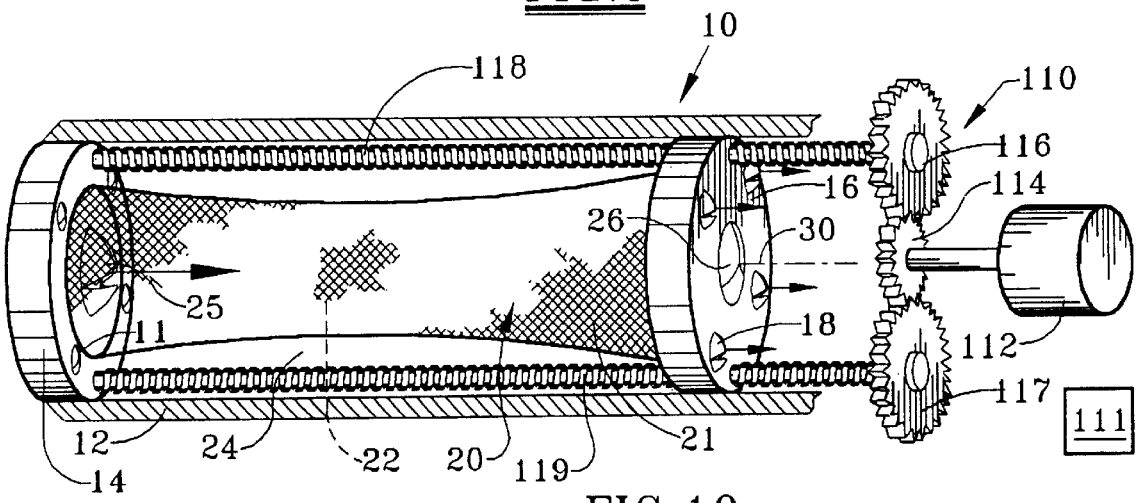
FIG. 10 is a pictorial view of an alternate embodiment of the propulsion device shown in FIG. 1.

FIG. 8 discloses another embodiment of a magnetic propulsion device 10 according to the present invention. In FIGS. 8–10, like reference numbers are used for components whose purpose and function was previously discussed. In the FIG. 8 embodiment, electromagnetic ring members 82 and 84 may, for purposes of illustration, be considered fixed to the housing 12. Each of the end plates 14, 16 thus move relative to the housing 12 and with respect to the fixed ring members 82, 84. Flow passages 86 and 88 may be provided in the ring members 82, 84 for transmitting fluid freely through the outer chamber 24. The flow passages 86 and 88 may have any desired cross-sectional configuration, and may be spiral shaped to facilitate vortex flow past the ring members 82, 84. In other embodiments, the ring members 82, 84 themselves may be formed in a manner such that the flow passageways may be eliminated. In still other embodiments, one or more of the ring members may be movable relative to the housing 12.

The propulsion device shown in FIG. 8 is an improvement over the device shown in FIG. 1 in that the spacing between the electromagnetic components is reduced in the FIG. 8 embodiment. During repulsion to decrease the volume of the inner chamber, the ring member 82 and cap 14 will thus have the same electric charge, while the ring member 84 and the cap 16 similarly have the same electric charge. The advantage of the FIG. 8 embodiment is that the spacing between the electromagnetic members has been decreased, thereby decreasing the power required to operate the electromagnetic decreased, thereby decreasing the power required to operate the electromagnetic propulsion device. During attraction of the end caps, ring member 82 and cap 14, and ring member 84 and cap 16, will have a different (attracting) charge. Before proceeding, it should be understood that in alternate embodiments the bladder 20 may be fixed to the electromagnetic members 82, 84 rather than passing through a central cavity in the ring members. Members 82, 84 are generally referred to as ring members, but in less preferred embodiments could have circumferential spacings between components. Also, while two ring members have been added in the FIG. 8 embodiment, one or three or more ring members or intermediate members may be provided in an electromagnetic propulsion device, or in the hydraulically powered and mechanically powered propulsion devices shown in FIGS. 9 and 10 respectively.

In the FIG. 9 embodiment, power to the electromagnetic device 10 is provided from a hydraulic control station 97 which controls the fluid pressure to each of the hydraulic lines 96. The hydraulically powered mechanism 90 thus includes an hydraulic cylinder 92 fixed to the end plate 14, with rod 94 extending to the end cap 16 along an axis parallel to the central axis 30. The cylinders are shown inside but could be placed radially outside the housing 12. Two or more hydraulic cylinders equally spaced about the circumference of the housing 12 are thus desired. It should be understood that the housing 12 also need not form a purely cylindrical chamber therein. The hydraulic system 90 also includes two cylinders 98 which may be fixed to a structure which in turn is fixed to the housing 12, with the rods 100 extending axially into engagement with the ring 16. Fluid pressure applied to the cylinders 92 will thus cause repulsion of the end plates 14, 16, while fluid pressure to the cylinders 98 will result in attraction of the end caps 14, 16, thereby achieving the desired fluid flow through the device. Conventional hydraulic circuits may be used to achieve this control, and such hydraulic circuits are known in the art. If desired, the propulsion device 10 as shown in FIG. 1 could be pneumatically powered.

FIG. 10 encloses one embodiment of mechanical drive mechanism 110 for achieving the desired repulsion and attraction of the end caps 16, 18. In this embodiment, the motor 112 is controlled by electrical control system 111 to achieve alternating forward and reverse rotation of the gear 114. Rotation of the gear 114 thus causes simultaneous rotation of the gears 116, 117 which drive the elongate rods 118, 119. The end of each of the rods 118, 119 thus rotates within a suitable receptacle fixed to the end cap 14. The rods 118, 119 as shown include a outer screw thread which mates with a corresponding thread within a bore of the end cap 16, such that rotation of the gears 116, 117 causes the end cap 16 to move axially with respect to the housing 112 in the direction of central axis 30. As with all the embodiments shown in FIGS. 8–10, suitable seals may be provided on each moveable end cap for continuous sealing engagement with an interior surface of the housing 12.

Although the propulsion device as disclosed herein has a single inlet valve to the inner chamber and a plurality of circumferentially spaced inlet valves to the outer chamber, a plurality of inlet valves could be provided for allowing water to flow into the inner chamber, and also a single valve theoretically could be provided for inputting water to the outer chamber. Similarly, multiple outlet valves could be provided for discharging water from the inner chamber and a single outlet valve could be provided for discharging water from the outer chamber.

Although the valves according to the present invention preferably are provided within flow paths within the incoming end cap or the outflowing end cap, the fluid flow to the outer chamber alternatively could be through other components. In order that the power supply 40 may control a magnetic attraction and repulsion of the end caps as explained herein, the end caps may be partially or entirely formed of material which is magnetic. In a preferred embodiment, a portion of the end cap is formed from an electromagnetic material or houses an electromagnet. In either event, the end caps effectively become electromagnetic so that the power supply 40 may cyclically vary power to the incoming end cap and outflowing end cap and thereby control movement of the incoming end cap with respect to the outflowing end cap along the central axis. It is also understood that the design could be varied to include the end caps as permanent magnets and/or to include a coiled electronic field to produce a solenoid like movement of the end caps.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. A propulsion device for moving a vessel through water, comprising:

a housing having a throughbore about a central axis;

an incoming end cap and an outflowing end cap each mounted along said throughbore and spaced axially from each other, one of said end caps being mounted for movement along the central axis relative to the other end cap;

a flexible generally tubular bladder interconnected at one end to said incoming end cap and at an opposite end to said outflowing end cap, the bladder defining (a) an inner chamber therein and between the end caps, and (b) an outer chamber between the bladder and the housing and between the end caps;

an incoming inner chamber check valve along a flow path interconnecting the water with the inner chamber;

an outflowing inner chamber check valve along a flow path interconnecting the inner chamber with the water;

at least one incoming outer chamber check valve each along a flow path interconnecting the water with the outer chamber;

at least one outflowing outer chamber check valve each along a flow path interconnecting the outer chamber with the water; and a power supply for controlling the attraction and repulsion of the end caps to cyclically move said one end cap with respect to the other end cap along the central axis in a manner which cyclically varies the volume of both the inner chamber and the outer chamber, thereby creating propulsion as water is drawn into and discharged from the device.

2. The propulsion device as defined in claim 1, wherein the incoming inner chamber check valve is positioned along a flow path through the incoming end cap and the outflowing inner chamber check valve is positioned along a flow path through the outflowing end cap.

3. The propulsion device as defined in claim 2, wherein each of the at least one incoming outer chamber check valves is positioned along a flow path through the incoming end cap and each of the at least one outflowing outer chamber check valves is positioned along a flow path through the outflowing end cap.

4. The propulsion device as defined in claim 1, wherein the bladder includes a fibrous reinforced weave formed from a fiber of a group consisting of carbon and an aromatic polyamide.

5. The propulsion device as defined in claim 1, wherein each of the incoming inner chamber check valve is a one-way valve having at least a pair of flaps.

6. The propulsion device as defined in claim 1, wherein each of the at least one incoming outer chamber check valves and the at least one outflowing outer chamber check valves is a one-way valve having at least a pair of flaps.

7. The propulsion device as defined in claim 1, wherein each of the incoming end cap and outflowing end cap contains an electromagnet; and the power supply cyclically varies electrical power to each of the incoming end cap and the outflowing end cap.

8. The propulsion device as defined in claim further comprising:

one or more additional electromagnetic members spaced between the incoming end cap and the outflowing end cap.

9. The propulsion device as defined in claim 1, wherein the power supply supplies hydraulic power to move one or more of the incoming end cap and the outflowing end cap with respect to the housing and thereby cause the attraction and repulsion of the end caps.

10. The propulsion device as defined in claim 9, wherein the power supply further includes:

one or more circumferentially spaced opening hydraulic cylinders for moving one or more of the incoming end cap and the outflowing end cap in an axial direction with respect to the housing to reduce the volume of the inner chamber and simultaneously increase the volume of the outer chamber; and one or more circumferentially spaced closing hydraulic cylinders for moving one or more of the incoming end cap and the outflowing end cap with respect to the housing to reduce the volume in the outer chamber and simultaneously increase the volume of the inner chamber.

11. The propulsion device as defined in claim 1, wherein the power supply includes an electrically powered motor and a gearing mechanism for moving one or more of the incoming end cap and outgoing end cap with respect to the housing and thereby cyclically alter the volume of the inner chamber and the outer chamber.

12. The propulsion device as defined in claim 1, further comprising:

a clamshell deflector moveable with respect to the housing from an inactive position to an active position, such that when in the active position water discharged from one or more of the outflowing inner chamber check valve and the at least one outflowing outer chamber check valve is deflected by the deflector to create a reverse thrust.

13. The propulsion device as defined in claim 1, further comprises:

a deflector secured to the housing for deflecting fluid from one or more of the outflowing inner chamber check valve and the outflowing outer chamber check valve to steer the propulsion device and the vessel through water.

14. The propulsion device as defined in claim 1, further comprising:

one or more sealing members carried on the one at said end caps mounted for movement for sealingly engaging the housing during movement of the moveable end cap with respect to the housing.

15. The propulsion device as defined in claim 1 wherein said incoming end cap is fixed to said housing.

16. A propulsion device for moving a vessel through water, comprising:

a housing having a throughbore about a central axis;

an incoming end cap and an oufflowing end cap mounted axially in said throughbore and spaced longitudinally from each other, one of said end caps being mounted for movement along the central axis relative to the other end cap;

a flexible generally tubular bladder including a fibrous reinforced weave interconnected at one end to said incoming end cap and at an opposite end to said outflowing end cap, the bladder defining (a) an inner chamber therein and between the end caps, and (b) an outer chamber between the bladder and the housing and between the end caps;

an incoming inner chamber check valve along a flow path interconnecting the water with the inner chamber;

an outflowing inner chamber check valve along a flow path interconnecting the inner chamber with the water;

at least one incoming outer chamber check valve each along a flow path interconnecting the water with the outer chamber;

at least one outflowing outer chamber check valve each along a flow path interconnecting the outer chamber with the water; and a power supply for controlling the attraction and repulsion of the end caps to cyclically move said one end cap with respect to the other end cap along the central axis in a manner which cyclically varies the volume of both the inner chamber and the outer chamber, thereby creating propulsion as water is drawn into and discharged from the device.

17. The propulsion device as defined in claim 16, wherein the incoming inner chamber check valve is positioned along a flow path through the incoming end cap, the outflowing inner chamber check valve is positioned along a flow path through the outflowing end cap, each of the at least one incoming outer chamber check valves is positioned along a flow path through the incoming end cap, and each of the at least one outflowing outer chamber check valves is positioned along a flow path through the outflowing end cap.

18. The propulsion device as defined in claim 16, wherein each of the incoming inner chamber check valve and outflowing inner chamber check valve is a one-way valve having at least a pair of flaps.

19. The propulsion device as defined in claim 16, further comprising:

a clamshell deflector moveable with respect to the housing from an active position to an active position, such that when in the active position water discharged from one or more of the outflowing inner chamber check valve and the at least one outflowing outer chamber check valve is deflected by the deflector to create a reverse thrust.

20. A method of powering a vehicle for moving through water, comprising:

providing a housing having a throughbore about a central axis;

providing an incoming end cap and an outflowing end cap along the central axis within the housing;

mounting one of said end caps for axial movement along the control axis relative to the other end cap;

interconnecting a flexible generally tubular bladder at one end to said incoming end cap and at an opposite end to said oufflowing end cap, the bladder defining (a) an inner chamber therein and between the end caps, and (b) an outer chamber between the bladder and the housing and between the end caps;

positioning an incoming inner chamber check valve along a flow path interconnecting the water with the inner chamber;

positioning an outflowing inner chamber check valve along a flow path interconnecting the inner chamber with the water;

positioning at least one incoming outer chamber check valve each along a flow path interconnecting the water with the outer chamber;

positioning at least one outflowing outer chamber check valve each along a flow path interconnecting the outer chamber with the water; and controlling the attraction and repulsion of the end caps to cyclically move one of said end caps with respect to the other end cap along the central axis in a manner which cyclically varies the volume of both the inner chamber and the outer chamber, thereby creating propulsion as water is drawn into and discharged from the housing.

21. The method as defined in claim 20, further comprising:

reinforcing the bladder with a fibrous reinforced weave.

22. The method as defined in claim 20, further comprising:

moving a clamshell deflector with respect to the housing from an inactive position to an active position, such that when in the active position water discharged from one or more of the outflowing inner chamber check valve and the at least one outflowing outer chamber check valve is deflected by the deflector to create a reverse thrust.

23. The method as defined in claim 20, wherein controlling the attraction and repulsion of the end caps includes providing an electromagnet within the incoming end cap and another electromagnet within the outflowing end cap, and cyclically controlling the power to the end caps to effect the volume of both the inner chamber and outer chamber.

24. The method as defined in claim 20, wherein controlling the attraction and repulsion of the end caps comprises:

supplying hydraulic power to one or more ram assemblies to move at least one of the incoming end cap and the outflowing end cap with respect to the housing to effect the varying volume of both the inner chamber and the outer chamber.

25. The method as defined in claim 20, wherein controlling the attraction and repulsion of the end caps comprises:

providing a motor to power a gear mechanism; and providing the gear mechanism between the motor and one or more of the incoming end cap and outgoing end cap to move one or more of the end caps with respect to the housing and thereby effect the varying volume of the inner chamber and the outer chamber.

* * * * *

UNITED STATES PATENT AND TRADEMARK OFFICE

CERTIFICATE OF CORRECTION

PATENT NO. : 6,352,455 B1 
DATED : March 5, 2002
INVENTOR(S) : Anthony C. Ross and Peter A. Guagliano It is certified that error appears in the above-identified patent and that said Letters Patent is hereby corrected as shown below:

Column 9,
Line 11, please change "in claim further" to -- in claim 7, further --

Signed and Sealed this

Twenty-seventh Day of August, 2002

*Attest:*

*Attesting Officer*

JAMES E. ROGAN
*Director of the United States Patent and Trademark Office*